US005389240A

United States Patent [19]

Gillespie et al.

[11] Patent Number: 5,389,240

[45] Date of Patent: * Feb. 14, 1995

[54] NAPHTHENIC ACID REMOVAL AS AN ADJUNCT TO LIQUID HYDROCARBON SWEETENING

[75] Inventors: Ralph D. Gillespie, Elgin; Blaise J. Arena, Chicago, both of Ill.

[73] Assignee: UOP, Des Plaines, Ill.

[ * ] Notice: The portion of the term of this patent subsequent to Feb. 15, 2011 has been disclaimed.

[21] Appl. No.: 100,848

[22] Filed: Aug. 2, 1993

[51] Int. Cl.[6] ..... C10G 19/073; C10G 27/00; C07C 7/12

[52] U.S. Cl. ..... 208/226; 208/191; 208/246; 208/247; 208/248; 208/249; 208/229; 585/850; 585/854

[58] Field of Search ..... 208/206, 207, 226, 143, 208/91, 181, 182, 183, 191, 192, 226, 228, 243, 244, 249, 250; 252/428; 585/820, 848, 850, 854, 247, 248, 299, 302, 246

[56] References Cited

U.S. PATENT DOCUMENTS

| | | | |
|---|---|---|---|
| 4,744,825 | 5/1988 | Chen et al. | 75/118 R |
| 4,752,397 | 6/1988 | Sood | 210/662 |
| 4,935,146 | 6/1990 | O'Neill et al. | 210/684 |
| 5,055,199 | 10/1991 | O'Neill et al. | 210/684 |
| 5,068,095 | 11/1991 | Nigro et al. | 423/122 |
| 5,286,372 | 2/1994 | Arena et al. | 208/207 |

OTHER PUBLICATIONS

J. R. Salazar in "Handbook of Petroleum Refining Processes", R. A. Meyers, editor, pp. 9-3 to 9-13.

*Primary Examiner*—Asok Pal
*Assistant Examiner*—Bekir L. Yildirim
*Attorney, Agent, or Firm*—Thomas K. McBride; Eugene I. Snyder

[57] ABSTRACT

Naphthenic acids may be efficiently and conveniently removed from liquid hydrocarbon feedstocks by passing such feedstocks through a bed of certain metal oxide solid solutions related to hydrotalcites. The removal of naphthenic acids is an important adjunct to sweetening sour feedstocks and is particularly applicable to kerosines whose acid numbers may range as high as about 0.8. The metal oxide solid solutions of our invention show high adsorption capacity and can readily remove at least 95% of the naphthenic acids present in a liquid hydrocarbon feedstock.

18 Claims, No Drawings

NAPHTHENIC ACID REMOVAL AS AN ADJUNCT TO LIQUID HYDROCARBON SWEETENING

BACKGROUND OF THE INVENTION

This invention relates to the removal of naphthenic acids from hydrocarbon feedstocks. More particularly, it relates to the removal of naphthenic acids from diverse liquid hydrocarbon feedstocks, especially as part of a sweetening process for the feedstock. Because of the rather particularized nature of our invention, it appears desirable to expound on certain current process characteristics so that the contributions of the present invention in advancing the relevant an can be better appreciated.

Many hydrocarbon streams have sulfur-containing compounds as undesirable components whose removal constitutes an important stage of hydrocarbon processing. Where these components are mercaptans their "removal" is generally only a conversion of mercaptans to disulfides which remain in the feedstock as inoffensive components of the hydrocarbon stream, a process usually referred to as "sweetening" (with the initial mercaptan-laden stream referred to as "sour" feedstock). The conversion of mercaptans to disulfides often is accomplished merely through air oxidation as catalyzed by various metal chelates; see J. R. Salazar in "Handbook of Petroleum Refining Processes", R. A. Meyers, editor, pages 9-3 to 9-13. But catalysis of mercaptan oxidation proceeds best in an alkaline environment—and therein hangs our tale.

The prior an has required a highly alkaline environment, typically achieved by strong bases such as alkali metal hydroxides (for example, caustic soda). Unfortunately, the caustic does not merely provide an alkaline environment but in time is neutralized by acidic components of the hydrocarbon stream, requiring its continued replacement and replenishment. Disposal of spent caustic solutions is itself an environmental problem, and proper disposal may exact a heavy financial penalty on the sweetening process. This is especially true for certain feedstocks, such as kerosene, which typically have a significant content of naphthenic acids.

Naphthenic acids are carboxylic acids found in petroleum and various petroleum fractions during their refining; see Kirk Othmer, "Encyclopedia of Science and Technology", 3rd Edition (1981), pp 749–53. Naphthenic acids are predominantly monocarboxylic acids having one or more cycloaliphatic groups alkylated in various positions with short chain aliphatic groups and containing a polyalkylene chain terminating in the carboxylic acid function. Although cyclopentane rings are the predominant cycloaliphatic ring structure, other cycloaliphatics tings, such as cyclohexanes, also may be present in appreciable quantities. The predominant acids are represented in Kirk Othmer by the formula,

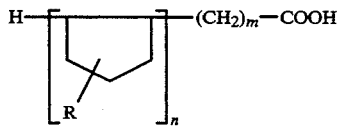

where n may range from 1 to 5, m is greater than 1, and R is a small aliphatic group, predominantly a methyl group. Since naphthenic acids are well known in the art their further characterization here is unnecessary and the interested reader may consult appropriate texts for additional information.

The naphthenic acid content of feedstocks such as kerosene engenders further complications arising from the limited solubility of alkali metal naphthenates in concentrated alkali. One consequence is that when a caustic—wet fixed bed oxidation catalyst is used—a common and otherwise economically favored variant—formation of insoluble alkali metal naphthenates tends to cause bed plugging. To avoid this, kerosene and kerosene-like feedstocks undergo a caustic prewash to remove naphthenic acids prior to entry of the feedstock to the fixed bed. But the solubility characteristics of the alkali metal naphthenates are such that their efficient extraction from kerosene-type feedstocks into aqueous media requires utilization of a dilute caustic (usually under 3 weight percent) prewash, which increases the volume of the spent caustic and further intensifies its disposal problem.

Although naphthenic acids are troublesome in the sweetening process they do have significant value as precursors to wood preservatives, oil-based paint dryers, surfactants, corrosion inhibitors, and lubricant additives. Their recovery is highly desirable, but in the scenario described above they must be recovered from a dilute aqueous solution, which imposes yet another financial burden.

The dilemma faced by a processor with the need to sweeten the liquid hydrocarbon feedstocks, and especially kerosene-type feedstocks, is multifaceted. The most desirable sweetening process which converts mercaptans to disulfides operates best in a caustic environment. The naphthenic acids in feedstocks previously have been removed in a caustic prewash to avoid reactor bed plugging, but the limited solubility of alkali metal naphthenates requires the use of dilute alkali, which exacerbates the disposal problem of spent caustic solutions. Although the naphthenic acids themselves are valuable commodities whose recovery might otherwise offset spent caustic disposal costs their recovery from dilute alkali is difficult and expensive, with little if any economic return. The result is that a high naphthenic acids content in a hydrocarbon feed imposes economic burdens on an otherwise simple chemical process.

The keystone of our invention is the recognition that certain metal oxide solid solutions related to hydrotalcite are effective adsorbents for naphthenic acids. This property permits the efficient removal of naphthenic acids from kerosene-type feedstocks specifically, and hydrocarbon feedstocks generally, using an adsorbent bed of the metal oxide solid solution prior to the sweetening process itself. Where adsorption of naphthenic acids is coupled with a process for desorption to regenerate the metal oxide solid solution it may be possible to recover the naphthenic acids themselves in a suitably concentrated form well adapted for a commercially economical naphthenic acid recovery program.

Before proceeding it appears advisable to avoid semantic confusion by defining several terms. The anionic clay known as hydrotalcite is a layered double hydroxide of ideal composition $Mg_6Al_2(OH)_{16}(CO_3).4H_2O$ where the carbonate anion is intercalated between infinite brucite-like sheets. Although "hydrotalcite" is most properly applied to a clay of composition which is $Mg_6Al_2(OH)_{16}(CO_3).4H_2O$ often it has been used to describe related layered double hydroxides with varying Mg/Al ratios. However, at least when the number ratio of Mg/Al atoms is less than 3, after calcination such materials are better described as solid solutions of magnesium oxide and aluminum oxide. That is, calcination destroys the layered structure characteristic of hydrotalcite and affords a solid solution. But the terminology as applied to such solid solutions often retains the "hydrotalcite" name, as in, for example, "synthetic hydrotalcites". In this application henceforth w shall try to be consistent in using the term "metal oxide solid solution" (occasionally referred to by the acronym MOSS) to describe such calcined synthetic materials. The second point involves the use of the term "Mg/Al" and analogous terms. In this application Mg/Al shall be the number ratio of magnesium to aluminum atoms in a solid solution of magnesium oxide and aluminum oxide. Others have used a different definition for the Mg/Al ratio.

Hydrotalcites, and more usually "calcined hydrotalcites," i.e., the metal oxide solid solutions formed in the calcination of hydrotalcites, have been used as adsorbents of anions, especially anions of complexed metals, but only in aqueous solution. For example, the patentee in U.S. Pat. No. 5,055,199 used as an adsorbent a "calcined hydrotalcite" of general formula $A_6B_2(OH)_{16}.4H_2O$, where A is a divalent cation of magnesium, nickel, iron, or zinc, B is a trivalent cation of aluminum, iron, or chromium, and C is a cation such as hydroxide, carbonate, nitrate, and halide. The hydrotalcite calcined at 400°-650° C. was effective in lowering amounts of cyanide, thiocyanate, thiosulfate, citrate, or EDTA complexes of various metals from aqueous streams; cf. U.S. Pat. Nos. 4,744,825, 4,752,397, 4,935,146, and 5,068,095, all of a common assignee, for related teachings. The critical observation is that all of these teachings refer to adsorption from aqueous solutions; to the best of our knowledge there is no art relating to adsorption by "calcined hydrotalcites" of materials from non-aqueous streams, particularly hydrocarbon streams.

SUMMARY OF THE INVENTION

In its broadest aspect the invention described within is a method of removing naphthenic acids from liquid hydrocarbon feedstocks. An embodiment comprises contacting a liquid hydrocarbon feedstock containing naphthenic acids at a level corresponding to an acid number of greater than 0.003 with a metal oxide solid solution to adsorb the naphthenic acids, and recovering as the effluent therefrom a liquid hydrocarbon feedstock containing naphthenic acids at a level corresponding to an acid number of less than 0.003. In a more specific embodiment the liquid hydrocarbon feedstock is kerosene. In a still more specific embodiment the kerosene has an acid number of at least 0.01. In another embodiment the metal oxide solid solution is one of magnesium oxide and aluminum oxide. Other embodiments will be apparent from the ensuing description.

DESCRIPTION OF THE INVENTION

The purpose of this invention is to efficiently and economically remove naphthenic acid from liquid hydrocarbon feedstocks containing naphthenic acids in an amount corresponding to an acid number of greater than 0.003. In many cases removal of naphthenic acids is preliminary to sweetening, or is an integral part of a sweetening process. Although the necessity for sweetening is a common characteristic of the feedstocks of this invention, it needs to be understood that sweetening is not a requirement or a necessary condition for the practice of our invention.

The feedstocks which may be used in the practice of our invention are petroleum derived liquid hydrocarbon feedstocks containing naphthenic acids, especially those feedstocks containing naphthenic acids, in a quantity corresponding to an acid number of greater than 0.003. By "acid number" is meant the amount of potassium hydroxide in milligrams necessary to neutralize the acid in 1 gram of feedstock. A naphthenic acid content corresponding to an acid number of about 0.01 is the maximum naphthenic acid content permissible to avoid bed plugging in a subsequent sweetening process (vide supra). However, for greater generality we may say that an acid number of 0.003 represents the least amount of naphthenic acid which a liquid hydrocarbon feedstock may contain in order to fruitfully practice this invention. In practice it is unlikely that feedstocks with an acid number as low as 0.003 would in fact need to have its naphthenic acids content reduced prior to sweetening, as by a basic prewash, but we emphasize that our invention can be used with feedstocks having such a low acid number.

The feedstocks may contain naphthenic acids corresponding to an acid number as high as about 4. The highest acid content feedstocks are gas oils, which may possess an acid number in the range 0.03 to 4, although more typical values are in the range from 0.03 to 1.0 with the value highly dependent on the crude source. High naphthenic acid feedstocks may be represented more typically by kerosene, whose acid number typically is in the range between about 0.01 and 0.06, but whose acid number may be as high as about 0.8. Examples of petroleum feedstocks which may be used in the practice of this invention include kerosene, middle distillates, light gas oil, heavy gas oil, jet fuel, diesel fuel, heavy naphtha, lube oil, stove oil, heating oil, and other petroleum fractions with an end point up to about 600° C. Kerosene is in some aspects the most important member of this group for the practice of our invention.

As was indicated earlier, the liquid hydrocarbon feedstocks are usually sour but are not invariably so. The necessity for sweetening is common to many feedstocks of interest, but we emphasize that this is not a necessary requirement in the practice of our invention. Where the feedstocks are to be sweetened they often contain between 0.05 and 0.8 weight percent (measured as elemental sulfur) of sulfur-containing compounds and from about 10 through about 5000 ppm of mercaptans (measured as mercaptan), although usually mercaptan levels are over 100 ppm.

A sour liquid hydrocarbon fraction often is sweetened in the presence of an oxidizing agent with a catalytic composite which comprises a metal chelate dispersed on an adsorbent support. The general sweetening process is described in R. A. Meyers, "Handbook of Petroleum Refining Processes", McGraw-Hill Book Co., 1986, pp 9-3 to 9-12; see also the general description in U.S. Pat. No. 5,039,398. The metal chelates used as catalysts are described in greater detail in U.S. Pat. Nos. 3,980,582, 2,966,453, 3,252,892, 2,918,426 and 4,290,913. The use of quaternary ammonium salts as an adjunct is described in greater detail in U.S. Pat. Nos. 4,157,312, 4,290,913 and 4,337,147. Teachings regarding alkaline agents may be found in U.S. Pat. Nos. 3,108,081 and 4,156,641.

The oxidizing agent is most often air admixed with the fraction to be treated, and the alkaline agent is usually an aqueous caustic solution charged continuously to the process or intermittently as required to maintain the catalyst in the caustic-wetted state. The metal chelate, and other optional components such as quaternary ammonium salts where used, can be dispersed on the adsorbent support in any conventional or otherwise convenient manner. The components can be dispersed on the support simultaneously from a common aqueous or alcoholic solution and/or dispersion thereof or separately and in any desired sequence. The dispersion process can be effected utilizing conventional techniques whereby the support in the form of spheres, pills, pellets, granules or other particles of uniform or irregular size or shape, is soaked, suspended, dipped one or more times, or otherwise immersed in an aqueous or alcoholic solution and/or dispersion to disperse a given quantity of the metal chelate. In general, the amount of metal phthalocyanine which can be adsorbed on the solid adsorbent support and still form a stable catalytic composite is up to about 25 weight percent of the composite. A lesser amount in the range of from about 0.1 to about 10 weight percent of the composite generally forms a suitably active catalytic composite.

Typically, the sour hydrocarbon fraction is contacted with the catalytic composite which is in the form of a fixed bed. The contacting is thus carried out in a continuous manner. An oxidizing agent such as oxygen or air, with air being preferred, is contacted with the fraction and the catalytic composite to provide at least the stoichiometric amount of oxygen required to oxidize the mercaptan content of the fraction to disulfides.

The treating conditions which may be used to carry out the present invention are those that have been disclosed in the prior art. The process is usually effected at ambient temperature conditions, although higher temperatures up to about 105° C. are suitably employed. Pressures of up to about 1,000 psi or more are operable although atmospheric or substantially atmospheric pressures are suitable. Contact times equivalent to a liquid hourly space velocity of from about 0.5 to about 10 or more are effective to achieve a desired reduction in the mercaptan content of a sour petroleum distillate, an optimum contact time being dependent on the size of the treating zone, the quantity of catalyst contained therein, and the character of the fraction being treated.

As previously stated, sweetening of the sour hydrocarbon fraction is effected by oxidizing the mercaptans to disulfides. Accordingly, the process is effected in the presence of an oxidizing agent, preferably air, although oxygen or other oxygen-containing gases may be employed. In fixed bed treating operations, the sour hydrocarbon fraction may be passed upwardly or downwardly through the catalytic composite. The sour hydrocarbon fraction may contain sufficient entrained air, but generally added air is admixed with the fraction and charged to the treating zone concurrently therewith. In some cases, it may be advantageous to charge the air separately to the treating zone and countercurrent to the fraction separately charged thereto. Examples of specific arrangements to carry out the treating process may be found in U.S. Pat. Nos. 4,490,246 and 4,753,722 which are incorporated by reference.

Our invention rests on the observation that certain classes of metal oxide solid solutions related to hydrotalcite clays are effective in removing naphthenic acids from liquid hydrocarbons. The precise mechanism by which the naphthenic acids are removed remains somewhat uncertain. Although the metal oxide solid solutions of our invention show anion exchange capacity, such behavior is measured in, and is more typical for, aqueous systems which support the presence of charged species such as anions. However, it is believed that water is not necessary for the removal of naphthenic acids from hydrocarbons, although water usually is present in conjunction with a sweetening process. Whatever is the mechanism of naphthenic acid removal by the metal oxide solid solutions of our invention, such solid solutions are observed to be quite effective in removing naphthenic acids from liquid hydrocarbons.

The novel materials employed in our invention are solid solutions of a divalent metal oxide and a trivalent metal oxide having an average general formula $M_x(II)M_y(III)O_{(x+1.5y)}$. The solid solutions result from calcination of synthetic hydrotalcite-like materials whose general formula may be expressed as $M_x(II)M_y(III)(OH)_zA_q.rH_2O$. M(II) is a divalent metal or combination of divalent metals selected from the group consisting of magnesium, calcium, barium, nickel, cobalt, iron, copper and zinc. M(III) is a trivalent metal or combination of trivalent metals selected from the group consisting of aluminum, gallium, chromium, iron, and lanthanum. A is an anion, most usually carbonate although other anions may be employed equivalently, especially anions such as nitrate, sulfate, chloride, bromide, hydroxide, and chromate. The case where M(II) is magnesium, M(III) is aluminum, and A is carbonate corresponds to the hydrotalcite series.

The ratio of the divalent and trivalent metals in the solid solutions is important, although it does not appear to be determinative of operability. Thus, the ratio x/y can vary between about 1 and about 10, with the interval of 1.5 to about 5 being preferred. We have found that such materials have excellent adsorption capacity and can readily remove 95% and greater of the naphthenic acids present in the liquid hydrocarbon.

We wish to emphasize that in the materials of our invention both M(II) and M(III) may be mixtures of metals belonging to the class defined by M(II) and M(III), respectively. So, for example, M(II) may be pure magnesium or may be both nickel and magnesium, or even nickel-magnesium-cobalt. Similarly, M(III) may be solely aluminum or a mixture of aluminum and chromium, or even a mixture of three trivalent metals such as aluminum, chromium, and gallium. In such cases the solid solutions still can be represented as $M_x(II)M_y(III)O_{(x+1.5\,y)}$, where x refers to the relative mole proportion of all of the divalent metal oxides and y refers to the relative mole proportion of all of the trivalent metal oxides. The preferred metal oxide solid solutions include the case where M(II)=Mg and M(III)=Al, and those where M(II) is a mixture of Mg and Ni.

The solid solutions of our invention with their unique properties result from their atypical preparation, especially as to their layered double hydroxide, hydrotalcite-like precursors. In particular, as described in more detail within, the precursor gel is prepared at a temperature not exceeding about 10° C., and preferably is prepared in the temperature interval between about 0° and 5° C. In addition, the crystallization time is kept short, on the order of an hour or two at 65° C., to afford layered double hydroxides whose calcination leads to materials of unusual hydrothermal stability, as discussed below. Calcination of the layered double hydroxide is effected at temperatures between about 400° and about 750° C. to afford the solid solutions used in the practice of this invention.

This invention may be practiced quite simply by contacting the metal oxide solid solutions of our invention with the liquid hydrocarbon feedstocks containing naphthenic acids under conditions and for a time effective to remove the naphthenic acids from the liquid hydrocarbons. Although our invention may be practiced in a batch mode merely by mixing a portion of a metal oxide solution with the liquid hydrocarbon feedstock to be treated, it is far more common and more effective to perform our invention in a continuous manner merely by passing the liquid hydrocarbon feedstock containing the naphthenic acid through a bed of an appropriate metal oxide solid solution. Thus, our invention is practiced in ways totally analogous to other procedures used for the adsorption of unwanted materials from a feedstock by a solid adsorbent. The temperatures used may be up to about 400° C., although it is far more likely that removal of naphthenic acids will be effected at a temperature between about 20° and about 100° C., and even more likely that our invention will be practiced in a temperature interval of 30°–80° C. Pressure has no material effect on our invention and consequently is not a relevant variable. The liquid hourly space velocity at which the liquid hydrocarbon feedstock is passed through the adsorbent bed is a function of temperature, the remaining adsorbent capacity of the metal oxide solid solution, and the naphthenic acid content of the feed. Liquid hourly space velocities between about 0.5 and about 20 are representative of those which can be expected to be employed.

The following examples are only illustrative of the practice of our invention which is not to be limited thereto. Other variants will be apparent to the person of ordinary skill in this art.

EXAMPLE 1

Preparation of Magnesium Oxide-Aluminum Oxide Solid Solution

A 2L, 3-necked round bottomed flask was equipped with an addition funnel, a thermometer, a mechanical stirrer, and a heating mantle. To this flask was added a solution containing 610 g of water, 60 g of $Na_2CO_3.H_2O$ and 71 g of NaOH and the contents were cooled to <5° C. The addition funnel was charged with a solution of 345 g water, 77 g $Mg(NO_3)_2.6H_2O$ and 75 g $Al(NO_3)_3.9H_2O$ and this solution was added over a period of 4 hours. The solution temperature was maintained at <5° C. throughout the addition and the resulting slurry was stirred for 1 hour at <5° C. The addition funnel was replaced by a reflux condenser and the slurry was heated to 60 ° ±5° C. for 1 hour. The slurry was then cooled to room temperature and the solids recovered by filtration. The solids were washed with 10 L of hot deionized (DI) water. The solids were then dried at 100° C. for 16 hours and this product was characterized as hydrotalcite by its x-ray diffraction (XRD) pattern. After crushing, the solid was calcined at 450° C. for 12 hours in a muffle furnace with an air flow. This product was characterized as a magnesium oxide-aluminum oxide solid solution (Mg/Al=1.5) by XRD. The BET surface area for this material was 285 $m^2/g$. Materials with a different Mg/Al ratio may be prepared by similar means, changing only the relative molar ratio of $Mg(NO_3)_2.6H_2O$ and $Al(NO_3)_3.H_2O$.

EXAMPLE 2

Preparation of Mg/Ni/Al Metal Oxide Solid Solutions

1. 5% Mg

A 2 L, 3-necked round bottomed flask was equipped with a reflux condenser, a thermometer, a mechanical stirrer, and a Glass Col heating mantle. To this 3-neck flask was added a solution containing 585 g of water, 60 g of $Na_2CO_3.H_2O$ and 71 g of NaOH. This flask was cooled to <5° C. An addition funnel was charged with a solution of 375 g water, 6.5 g $Mg(NO_3)_2.H_2O$, 139 g $Ni(NO_3)_2.6H_2O$ and 93 g $Al(NO_3)_3.9H_2O$. The addition funnel was put in place of the reflux condenser. This solution was added over a period of 4 hours. The solution temperature was maintained at <5° C. throughout the addition. This slurry was stirred for 1 hour at <5° C. The addition funnel was removed and the reflux condenser replaced. This solution was heated to 60° C. ±5° C. for 1 hour. The slurry was then cooled to room temperature and the solids recovered by filtration. The solids were washed with 10 L of hot DI water. The solids were then dried at 100° C. for 16 hours. This product was characterized as hydrotalcite by its XRD pattern. After crushing, the solid was calcined at 450° C. for 12 hours in a muffle furnace with an air flow. This product was characterized as a magnesium oxide-nickel oxide-aluminum oxide solid solution by XRD. The BET surface area for this material was 205 $m^2/g$. Alternatively, the hydrotalcite slurry/paste can be extruded prior to drying and calcining. The gram-atom ratio of Mg/(Mg+Ni)=0.05, and (Mg+Ni)/Al=2.

2. 25% Mg

A 2 L, 3-necked round bottomed flask was equipped with a reflux condenser, a thermometer, a mechanical stirrer, and a Glass Col heating mantle. To this 3-neck flask was added a solution containing 585 g of water, 60 g of $Na_2CO_3.H_2O$ and 71 g of NaOH. This flask was cooled to <5° C. An addition funnel was charged with a solution of 378 g water, 32.5 g $Mg(NO_3)_2.6H_2O$, 110 g $Ni(NO_3)_2.6H_2O$ and 93 g $Al(NO_3)_3 9H_2O$. The addition funnel was put in place of the reflux condenser. This solution was added over a period of 4 hours. The solution temperature was maintained at <5° C. throughout the addition. This slurry was stirred for 1 hour at <5° C. The addition funnel was removed and the reflux condenser replaced. This solution was heated to 60° C.±5° C. for 1 hour. The slurry was then cooled to room temperature and the solids recovered by filtration. The solids were washed with 10 L of hot DI water. The solids were then dried at 100° C. for 16 hours. This product was characterized as hydrotalcite by its XRD pattern. After crushing, the solid was calcined at 450° C. for 12 hours in a muffle furnace with an air flow. This product was characterized as a magnesium oxide-nickel oxide-aluminum oxide solid solution by XRD. The BET surface area for this material was 199 $m^2/g$. Alternatively, the hydrotalcite slurry/paste can be extruded prior to drying and calcining. The gram-atom ratio Mg/(Mg+Ni)=0.25, and (Mg+Ni)/Al=2.0

3. 50% Mg

A 2 L, 3-necked round bottomed flask was equipped with a reflux condenser, a thermometer, a mechanical stirrer, and a Glass Col heating mantle. To this 3-neck flask was added a solution containing 592 g of water, 60 g of $Na_2CO_3.H_2O$ and 71 g of NaOH. This flask was cooled to <5° C. An addition funnel was charged with a solution of 375 g water, 65 g $Mg(NO_3)_2.6H_2O$, 73.5 g $Ni(NO_3)_2.6H_2O$ and 93 g $(Al(NO_3)_3.9H_2O$. The addition funnel was put in place of the reflux condenser. This solution was added over a period of 4 hours. The solution temperature was maintained at <5° C. throughout the addition. This slurry was stirred for 1 hour at <5° C. The addition funnel was removed and the reflux condenser replaced. This solution was heated to 60° C.±5° C. for 1 hour. The slurry was then cooled to room temperature and the solids recovered by filtration. The solids were washed with 10 L of hot DI water. The solids were then dried at 100° C. for 16 hours. This product was characterized as hydrotalcite by its XRD pattern. After crushing, the solid was calcined at 450° C. for 12 hours in a muffle furnace with an air flow. This product was characterized as a magnesium oxide-nickel oxide-aluminum oxide solid solution by XRD. The BET surface area for this material was 212 $m^2/g$. Alternatively, the hydrotalcite slurry/paste can be extruded prior to drying and calcining. The gram-atom ratio Mg/(Mg+Ni)=0.5 and (Mg+Ni)/Al=2.0.

EXAMPLE 3

Preparation of a Nickel-Aluminum MOSS

To a solution of 72.1 g NaOH and 57.1 g $Na_2CO_3$.-H2O in 618 g water cooled to <5° C. was added a solution of 150.1 g. nickel nitrate hexahydrate, 96.2 g aluminium nitrate nonahydrate in 342 g water over a period of 77 minutes. The solution was then heated at 60° C. for 20 hours, after which solids were collected by filtration and washed with 12 L of warm water. The solids were dried at 100° C. for approximately 16 hours, then calcined at 450° C. for about 12 hours. The product was characterized as a nickel oxide-aluminum oxide solid solution with a Ni/Al ratio of 2.

EXAMPLE 4

Preparation of Disulfonated Cobalt Phthalocyanine (DsCoPc) on a MOSS

1. Ds-CoPc on Ni-Al MOSS 0.35 Grams of disulfonated cobalt phthalocyanine were dissolved in 50 cc of dry methanol. The solution was placed in a 500 cc air jacketed glass vessel. 50 Grams of the Ni-Al MOSS from Example 3 were placed into the solution in the vessel. The vessel was placed on a rolling mechanism and rolled for 16 hrs until dry. A flow of 100 cc/min of $N_2$ was maintained through the vessel until complete.

2. DsCoPc on Ni-Mg(25%)Al-MOSS 0.35 Grams of disulfonated cobalt phthalocyanine were dissolved in 60 cc of dry methanol. The solution was placed in a 500 cc air jacketed glass vessel. 60.15 Grams of the Ni-Mg(25%)-Al MOSS was placed into the solution in the vessel. The vessel was placed on a rolling mechanism and rolled for 1 hr. at room temperature. Steam was introduced into the jacket and the material was rolled for another hour. A flow of 100 cc/min of $N_2$ was maintained through the vessel until complete.

EXAMPLE 5

A reactor containing 40 cc of a Mg-Ni-Al MOSS (25% Mg—see Example 2) at 38° C. was placed prior to a reactor containing 7.5 cc of DsCoPc on activated charcoal. A commercial sample of kerosine containing mercaptan (381 wppm sulfur), naphthenic acids (acid no. 0.064), 7000 wppm water and 8.75 wppm of a quaternary ammonium hydroxide was passed first into the MOSS-containing reactor, then into the DsCoPc-containing reactor at a pressure of 100 psig along with oxygen at approximately 4 times the stoichiometric amount needed for oxidation of the mercaptan to disulfide. The results summarized in Table 1 show quite high (95+%) removal of naphthenic acids even at high liquid hourly space velocities.

TABLE 1

Stability of 2:1 (25% Mg-75% Ni)-MOSS + DsCoPc Catalyst Stacked Beds.

| Time (hours) | LHSV ($hr^{-1}$) | % Acid Adsorbed | % Acid Adsorption Capacity Remaining |
|---|---|---|---|
| 8 | 1.1 | 93.8 | 99.8 |
| 12 | 1.1 | 98.4 | 99.6 |
| 16 | 7.5 | 95.3 | 99.5 |
| 20 | 7.5 | 98.4 | 98.7 |
| 24 | 7.5 | 98.4 | 97.9 |
| 28 | 7.5 | 98.4 | 97.1 |
| 32 | 7.5 | 95.3 | 96.3 |
| 36 | 7.5 | 98.4 | 95.5 |
| 40 | 7.5 | 96.9 | 94.7 |
| 44 | 7.5 | 98.4 | 93.8 |
| 48 | 7.5 | 96.9 | 93.0 |
| 52 | 7.5 | 98.4 | 92.2 |
| 56 | 7.5 | 98.4 | 91.4 |
| 60 | 7.5 | 98.4 | 90.6 |
| 64 | 7.5 | 98.4 | 89.8 |
| 68 | 1.1 | 98.4 | 89.7 |
| 76 | 1.1 | 90.6 | 89.5 |
| 80 | 1.1 | 98.4 | 89.4 |
| 100 | 1.1 | 98.4 | 88.7 |

EXAMPLE 6

In this example there was no bed of DsCoPc and 38 cc of MOSS was used, but all other conditions and the kerosine feedstock were identical to those of the previous example. The results of Table 2 show >98% removal of naphthenic acids.

TABLE 2

Stability of 2:1 (25% Mg-75% Ni)-MOSS

| Time (hours) | LHSV ($hr^{-1}$) | % Acid Adsorbed | % Acid Adsorption Capacity Remaining |
|---|---|---|---|
| 4 | 1.2 | 98.4 | 99.9 |
| 8 | 1.2 | 98.4 | 99.7 |
| 12 | 1.2 | 98.4 | 99.6 |
| 16 | 1.2 | 98.4 | 99.5 |
| 20 | 1.2 | 98.4 | 99.3 |
| 24 | 1.2 | 98.4 | 99.2 |

EXAMPLE 7

In this example a single reactor packed with 15 cc of DsCoPc on a Ni-Al MOSS (see Example 4) was used with the same kerosine feedstock and at the same operating conditions as described in Example 5. Results are summarized in Table 3.

TABLE 3

Stability of 2:1 Ni-MOSS Catalyst

| Time (hours) | LHSV ($hr^{-1}$) | % Acid Adsorbed | % Acid Adsorption Capacity Remaining |
|---|---|---|---|
| 4 | 3 | 90.6 | 99.7 |
| 8 | 3 | 89.1 | 99.3 |
| 12 | 3 | 87.5 | 99.0 |
| 16 | 3 | 65.6 | 98.7 |
| 20 | 3 | 71.9 | 98.3 |
| 24 | 3 | 70.3 | 98.0 |
| 28 | 20 | 45.3 | 95.8 |

TABLE 3-continued

| Stability of 2:1 Ni-MOSS Catalyst | | | |
|---|---|---|---|
| Time (hours) | LHSV ($hr^{-1}$) | % Acid Adsorbed | % Acid Adsorption Capacity Remaining |
| 32 | 20 | 35.9 | 93.6 |
| 36 | 20 | 34.4 | 91.4 |
| 40 | 20 | 32.8 | 89.2 |
| 44 | 20 | 34.4 | 87.0 |
| 52 | 20 | 26.6 | 82.6 |
| 56 | 20 | 28.1 | 80.4 |
| 60 | 20 | 28.1 | 78.1 |
| 64 | 3 | 53.1 | 77.8 |
| 68 | 3 | 50.0 | 77.5 |
| 72 | 3 | 53.1 | 77.2 |
| 76 | 3 | 46.9 | 76.8 |
| 80 | 3 | 56.3 | 76.5 |

EXAMPLE 8

This example was similar to the foregoing one with the reactor packed with 15 cc of DsCoPc on a Mg-Ni-Al MOSS (see Example 4). The results of Table 4 show that the MOSS was somewhat more efficient in removing naphthenic acids.

TABLE 4

| Stability of 2:1 (25% Mg-75% Ni)-MOSS Catalyst | | | |
|---|---|---|---|
| Time (hours) | LHSV ($hr^{-1}$) | % Acid Adsorbed | % Acid Adsorption Capacity Remaining |
| 4 | 3 | 90.6 | 99.7 |
| 8 | 3 | 93.8 | 99.3 |
| 12 | 3 | 96.9 | 99.0 |
| 16 | 20 | 93.8 | 96.8 |
| 20 | 20 | 96.9 | 94.6 |
| 24 | 20 | 95.3 | 92.4 |
| 28 | 20 | 92.2 | 90.2 |
| 32 | 20 | 85.9 | 88.0 |
| 36 | 20 | 90.6 | 85.8 |
| 40 | 20 | 92.2 | 83.6 |
| 44 | 20 | 79.7 | 81.3 |
| 48 | 20 | 68.8 | 79.1 |
| 52 | 20 | 59.4 | 76.9 |
| 56 | 20 | 51.6 | 74.7 |
| 60 | 20 | 43.8 | 72.5 |
| 64 | 3 | 43.8 | 72.2 |
| 68 | 3 | 56.3 | 71.9 |
| 72 | 3 | 62.5 | 71.5 |
| 76 | 3 | 70.3 | 71.2 |
| 80 | 3 | 62.5 | 70.9 |
| 84 | 3 | 65.6 | 70.5 |
| 88 | 3 | 64.1 | 70.2 |

EXAMPLE 9

Adsorption of Naphthenic Acid in Absence of Water

A total of 200 ml of a solution of naphthenic acids (0.11 g) in hexane (1100 g) was passed over 25 cc of a Mg-Al MOSS (see Example 1) in a glass column. The acid number of the feed was 0.013, whereas that of the effluent was <0.001.

What is claimed is:

1. In the method of sweetening a mercaptan-containing hydrocarbon feedstock by the oxidation of mercaptans to disulfides catalyzed by metal chelates in an alkaline environment, where said hydrocarbon feedstock contains naphthenic acids in an amount corresponding to an acid number of greater than 0.003, the improvement comprising flowing the hydrocarbon feedstock prior to sweetening through a bed of a solid solution of at least one divalent metal oxide selected from the group consisting of magnesium, calcium, barium, nickel, cobalt, iron and zinc and aluminum oxide at conditions effective to remove naphthenic acids by said solid solution to afford a hydrocarbon feedstock containing naphthenic acids in an amount corresponding to an acid number less than 0.003.

2. The method of claim 1 where the hydrocarbon feedstock is selected from the group consisting of kerosene, middle distillates, light gas oil, heavy gas oil, jet fuel, diesel fuel, heavy naphtha, lube oil, stove oil, heating oil, and other petroleum fractions having an end point up to about 600° C.

3. The method of claim 2 where the hydrocarbon feedstock is kerosene.

4. The method of claim 1 where the hydrocarbon feedstock has an acid number up to about 4.

5. The method of claim 1 where the hydrocarbon feedstock is kerosene having an acid number between about 0.01 to about 0.8.

6. The method of claim 4 where the hydrocarbon feedstock has an acid number between about 0.03 to about 1.0.

7. The method of claim 1 where the metal is magnesium.

8. The method of claim 1 where the metal is a combination of magnesium and nickel.

9. The method of claim 1 where the metal of the divalent metal oxide is magnesium, nickel, or any combination thereof.

10. A method of reducing the naphthenic acids content of a liquid hydrocarbon feedstock having naphthenic acids in an amount corresponding to an acid number of greater than 0.003 comprising contacting the liquid hydrocarbon feedstock with a solid solution of at least one divalent metal oxide selected from the group consisting of magnesium, calcium, barium, nickel, cobalt, iron and zing and aluminum oxide under conditions effective to remove naphthenic acids, and recovering therefrom a naphthenic acids-depleted liquid hydrocarbon feedstock having an acid number less than 0.003.

11. The method of claim 10 where the liquid hydrocarbon feedstock is selected from the group consisting of kerosene, middle distillates, light gas oil, heavy gas oil, jet fuel, diesel fuel, heavy naphtha, lube oil, stove oil, heating-oil, and other petroleum fractions having an end point up to about 600° C.

12. The method of claim 11 where the liquid hydrocarbon feedstock is kerosene.

13. The method of claim 10 where the liquid hydrocarbon feedstock has an acid number up to about 4.

14. The method of claim 10 where the liquid hydrocarbon feedstock is kerosene having an acid number between about 0.01 to about 0.8.

15. The method of claim 13 where the liquid hydrocarbon feedstock has an acid number between about 0.03 to about 1.0.

16. The method of claim 10 where the metal is magnesium.

17. The method of claim 10 where the metal is a combination of magnesium and nickel.

18. The method of claim 10 where the metal of the divalent metal oxide is magnesium, nickel, or any combination thereof.

* * * * *